US005996283A

United States Patent [19]

Maier

[11] Patent Number: 5,996,283

[45] Date of Patent: Dec. 7, 1999

[54] HOUSING ASSEMBLY FOR INSTALLATION IN A WINDOW FRAME

[75] Inventor: Robert G. Maier, Hudson, Ohio

[73] Assignee: Ro-Mai Industries, Inc., Twinsburg, Ohio

[21] Appl. No.: 09/009,641

[22] Filed: Jan. 20, 1998

[51] Int. Cl.[6] ..... E05D 15/22

[52] U.S. Cl. ..... 49/181; 49/445

[58] Field of Search ..... 49/180, 181, 185, 49/182, 445, 446; 292/175

[56] References Cited

U.S. PATENT DOCUMENTS

| | | | |
|---|---|---|---|
| 4,074,465 | 2/1978 | Bright | 49/440 |
| 4,167,835 | 9/1979 | Nobes et al. . | |
| 4,262,449 | 4/1981 | Riegelman et al. | 49/446 |
| 4,320,597 | 3/1982 | Strener, Jr. . | |
| 4,400,026 | 8/1983 | Brown, Jr. . | |
| 4,475,311 | 10/1984 | Gibson . | |
| 4,553,353 | 11/1985 | Simpson . | |
| 4,578,903 | 4/1986 | Simpson . | |
| 4,622,778 | 11/1986 | Simpson . | |
| 4,624,073 | 11/1986 | Randall . | |
| 4,640,048 | 2/1987 | Winner et al. . | |
| 4,669,765 | 6/1987 | Ullman . | |
| 4,790,579 | 12/1988 | Maxwell et al. . | |
| 4,791,756 | 12/1988 | Simpson . | |
| 4,837,975 | 6/1989 | Simpson . | |
| 4,869,020 | 9/1989 | Andres . | |
| 4,901,475 | 2/1990 | Simpson . | |
| 4,922,657 | 5/1990 | Foss | 49/181 |
| 4,926,524 | 5/1990 | Owens | 49/181 |
| 4,955,159 | 9/1990 | Rogers . | |
| 4,961,286 | 10/1990 | Bezubic . | |
| 5,014,466 | 5/1991 | Winner . | |
| 5,028,083 | 7/1991 | Mischenko . | |
| 5,096,240 | 3/1992 | Schultz . | |
| 5,121,951 | 6/1992 | Harbom et al. . | |
| 5,127,685 | 7/1992 | Dallaire et al. . | |
| 5,139,291 | 8/1992 | Schultz . | |
| 5,165,737 | 11/1992 | Riegelman . | |
| 5,251,401 | 10/1993 | Prete et al. | 49/181 |
| 5,301,989 | 4/1994 | Dallmann et al. . | |
| 5,618,067 | 4/1997 | Carlson et al. . | |
| 5,669,180 | 9/1997 | Maier | 49/181 |
| 5,671,958 | 9/1997 | Szapucki et al. | 292/175 |
| 5,704,165 | 1/1998 | Slocomb et al. | 49/181 |
| 5,829,196 | 11/1998 | Maier | 49/181 |

*Primary Examiner*—Daniel P. Stodola
*Assistant Examiner*—Curtis A. Cohen
*Attorney, Agent, or Firm*—Pearne, Gordon, McCoy & Granger LLP

[57] ABSTRACT

Plural protuberances are provided along each side of a tilt latch or pivot housing. The protuberances each form an edge that engages an edge of a notch in a window sash. The protuberances are provided with flexible fingers that are flexed or sheared by the sash edges to provide a snug fit.

26 Claims, 5 Drawing Sheets

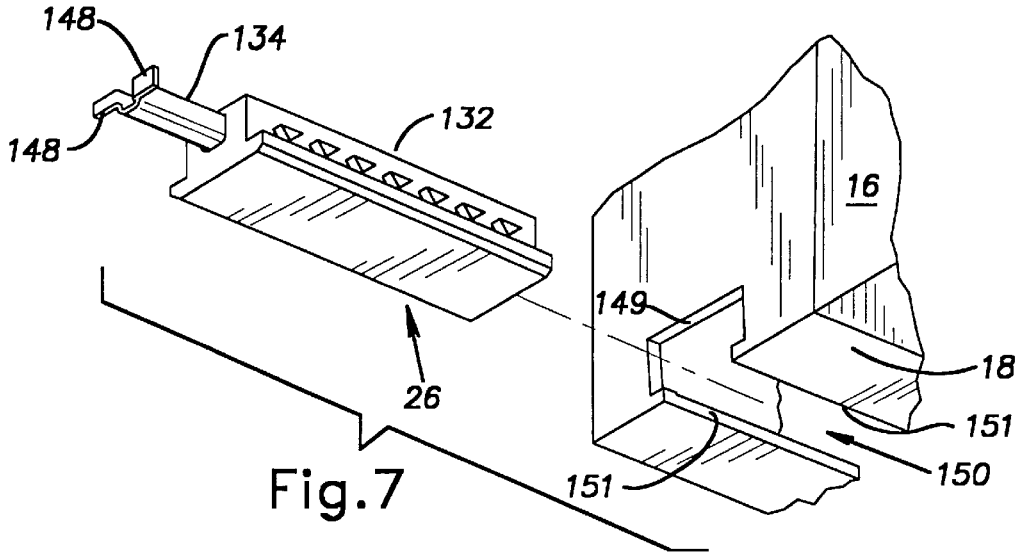
Fig.7
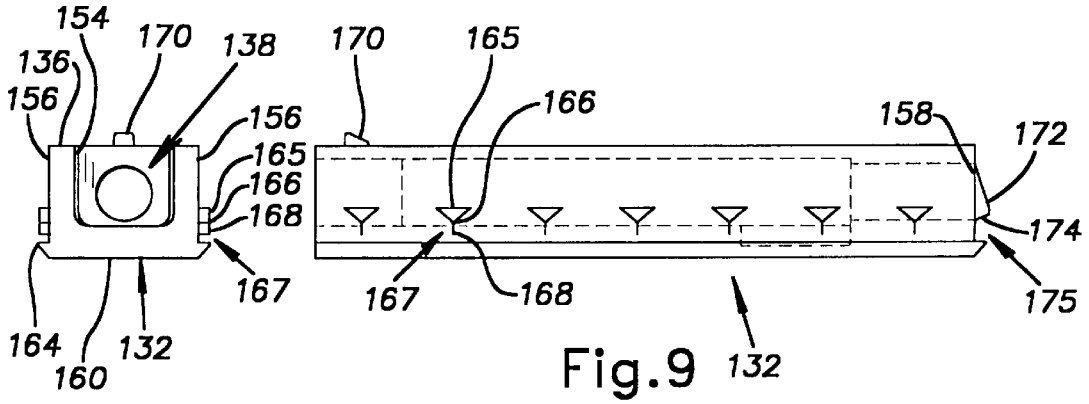
Fig.9
Fig.8

HOUSING ASSEMBLY FOR INSTALLATION IN A WINDOW FRAME

CROSS-REFERENCE TO RELATED APPLICATIONS

Not Applicable

STATEMENT REGARDING FEDERALLY SPONSORED

RESEARCH OR DEVELOPMENT

Not Applicable

BACKGROUND OF THE INVENTION

This invention relates generally to the field of window hardware and specifically to a tilt latch or pivot housing.

Double hung windows are provided with counterbalances for maintaining a sash in an elevated position. Springs or weights connected to the sash act as the counterbalance. Many window sashes are adapted for tilting inwardly for cleaning. The sash tilts on a pivot assembly at the bottom of the sash. Spring operated tilt latches at the top of the sash retain the sash in the vertical position and are released for pivoting of the sash. Latches, generally tilt latches, are shown, for example, in U.S. Pat. No. 4,837,975 to Simpson, U.S. Pat. No. 4,901,475 to Simpson, U.S. Pat. No. 4,167,835 to Nobes, U.S. Pat. No. 4,578,903 to Simpson, U.S. Pat. No. 4,475,311 to Gibson, U.S. Pat. No. 4,955,159 to Rogers, U.S. Pat. No. 4,869,020 to Andres, U.S. Pat. No. 4,961,286 to Bezubic, U.S. Pat. No. 4,790,579 to Maxwell, U.S. Pat. No. 4,553,353 to Simpson, U.S. Pat. No. 4,475,311 to Gibson, U.S. Pat. No. 4,400,026 to Brown, U.S. Pat. No. 4,791,756 to Simpson, U.S. Pat. No. 4,578,903 to Simpson, U.S. Pat. No. 4,320,597 to Sterner, U.S. Pat. No. 4,640,048 to Winner, U.S. Pat. No. 4,622,778 to Simpson, U.S. Pat. No. 4,624,073 to Randall, U.S. Pat. No. 4,669,765 to Ullman, U.S. Pat. No. 5,301,989 to Dallmann, U.S. Pat. No. 5,028,083 to Mischenko, U.S. Pat. No. 5,096,240 to Schultz, U.S. Pat. No. 5,127,685 to Dallaire, U.S. Pat. No. 5,165,737 to Riegelman, U.S. Pat. No. 5,014,466 to Winner, and U.S. Pat. No. 5,139,291 to Schultz, all of which are incorporated herein by reference.

FIGS. 14 and 15 show a prior art tilt latch housing. A housing 250 includes a bottom wall 254, side walls 256, a rear wall 258, and a top wall 260 defining a hollow cavity 262 opening at a front end of the housing. The top wall 260 defines a flange 264 at the top of the side and rear walls 256, 258. Retainers 261 project from the side walls 256 and rear wall 258. Each retainer slopes outwardly from the wall to a lip 269 that defines a catch for engaging edges of a notch in a header rail of a sash. The space between the lip 269 and flange 264 defines a gap or short groove 263 for receiving an edge of the sash therein. A retainer tab 270 projects downwardly from the bottom wall 254 near the front end of the housing 250.

FIGS. 16 and 17 show another prior art tilt latch housing an upper part 351 and a lower part 353. The lower part 353 defines a bottom wall 354, external side walls 356, and a rear wall 358. The upper part defines internal side wall 357 and a top wall 360. The upper and lower parts 351, 353 are assembled to define a hollow cavity 362 opening at a front end of the housing. The top wall 360 defines a flange 364 at the top of the internal side walls 357 and spaced from the rear wall 358 and external side walls 356. The top edges of the side walls 356 cooperate with the flange 364 to define longitudinal grooves.

BRIEF SUMMARY OF THE INVENTION

The present invention provides a housing for installation in a window frame having a window sash with a notch defining a pair of opposed edges. The housing includes side walls, a rear wall, and a top wall extending beyond the side walls and rear wall to define a flange. A retainer, such as a protuberance, projects from each of the side walls. Each protuberance has an apex spaced from the flange to define respective gaps for receiving the edges therein. The finger projects from each retainer into the respective gap. The fingers have a thickness permitting flexing or shearing thereof when the edges are received in the gaps.

Preferably, the side walls are provided with plural protuberances each defining a respective gap between the protuberance and the flange and each having a finger projecting from the protuberance into the gap. The protuberances are substantially evenly spaced along the length of each side wall. The protuberances are triangular and a corner of the triangle defines the apex. The protuberances can be flared. A rear protuberance projects from the rear wall and is spaced from the flange to define a gap for receiving the rear edge of the notch. The housing also includes a bottom wall and a retainer projecting from the bottom wall near a front edge of the bottom wall. The housing is molded as a single piece. A pivot bar or movable bolt projects from the housing.

The invention also includes a window sash assembly. A sash has a header rail and a stile joined at a corner and having an opening in the sash. A tilt latch disposed in the opening includes a housing having side walls, a rear wall, and a bottom wall. A top wall extends beyond the side walls and rear wall to define a flange. A protuberance projects from each of the side walls, each protuberance having an apex spaced from the flange to define respective gaps for receiving the edges therein. A bolt is movably disposed in the housing and adapted for engaging a slide channel. A finger projects from each protuberance into the respective gap.

BRIEF DESCRIPTION OF THE SEVERAL VIEWS OF THE DRAWING

FIG. 7 shows a perspective view of a pivot assembly and part of the sash;

FIG. 8 shows an end view of the pivot assembly;

FIG. 9 shows a side view of the pivot assembly

DESCRIPTION OF THE INVENTION

Figure 1:
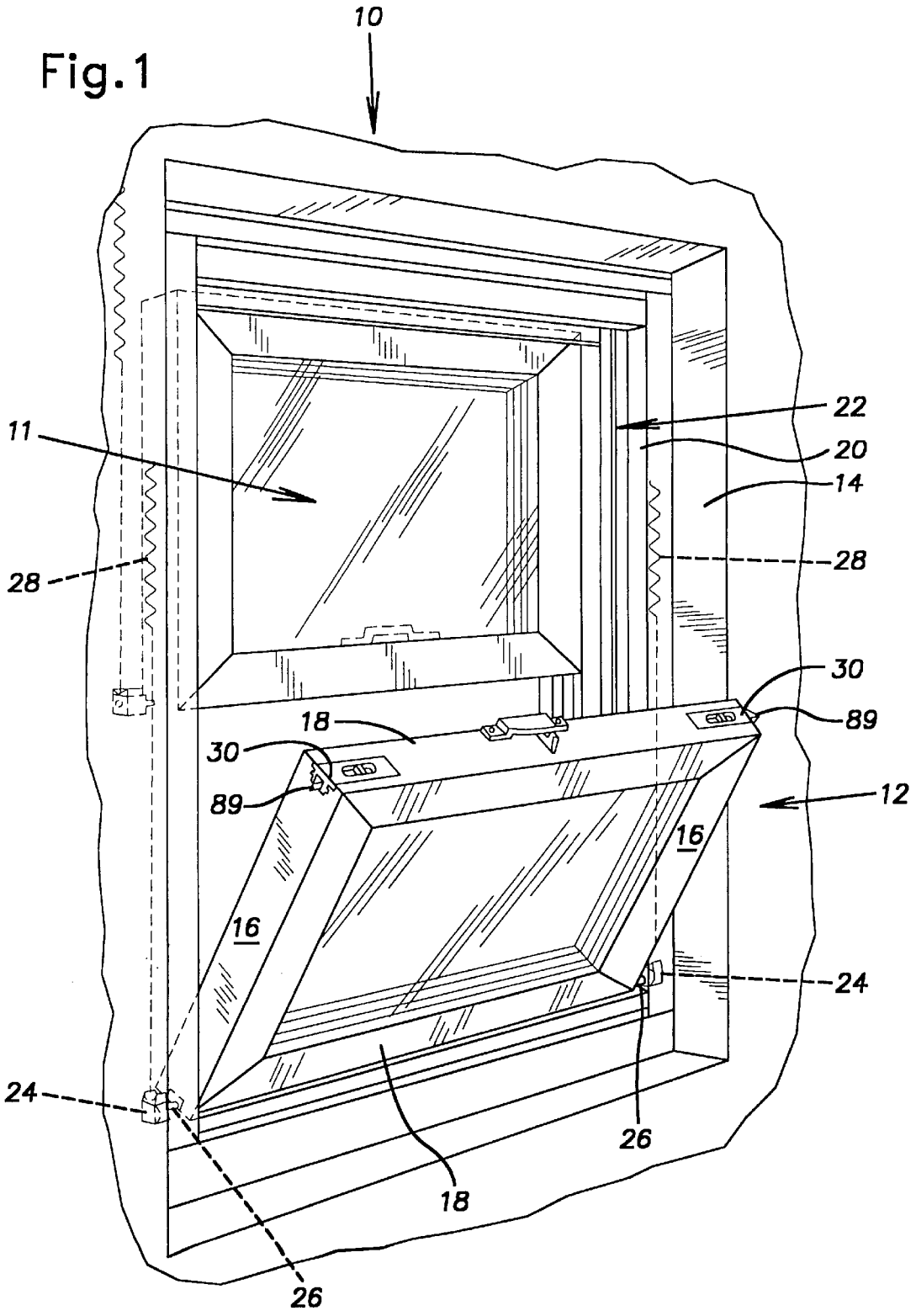
FIG. 1 shows a perspective view of a double hung window according to the invention.

Referring to FIG. 1, a double hung window assembly 10 includes an upper sash 11 and a lower sash 12 that are slidable in a window frame 14. The lower sash 12, for example, includes vertically disposed stiles 16 and horizontally disposed rails 18 including an upper header rail and a lower footer rail. The window frame includes vertical jambs 20 defining opposed vertical slide channels 22 or tracks. Brake assemblies 24 are slidable in respective slide channels 22. Lower corners of the sash 12 are provided with pivot assemblies 26 that are associated with respective brake assemblies 24 to define pivot and brake assemblies. The brake assemblies 24 are supported by respective counterbalances, such as balance springs 28 disposed in the slide channels 22. Tilt latches 30 are disposed in upper corners of the sash 12 for releasably retaining the upper end of the sash in the slide channels 22.

Figure 2:
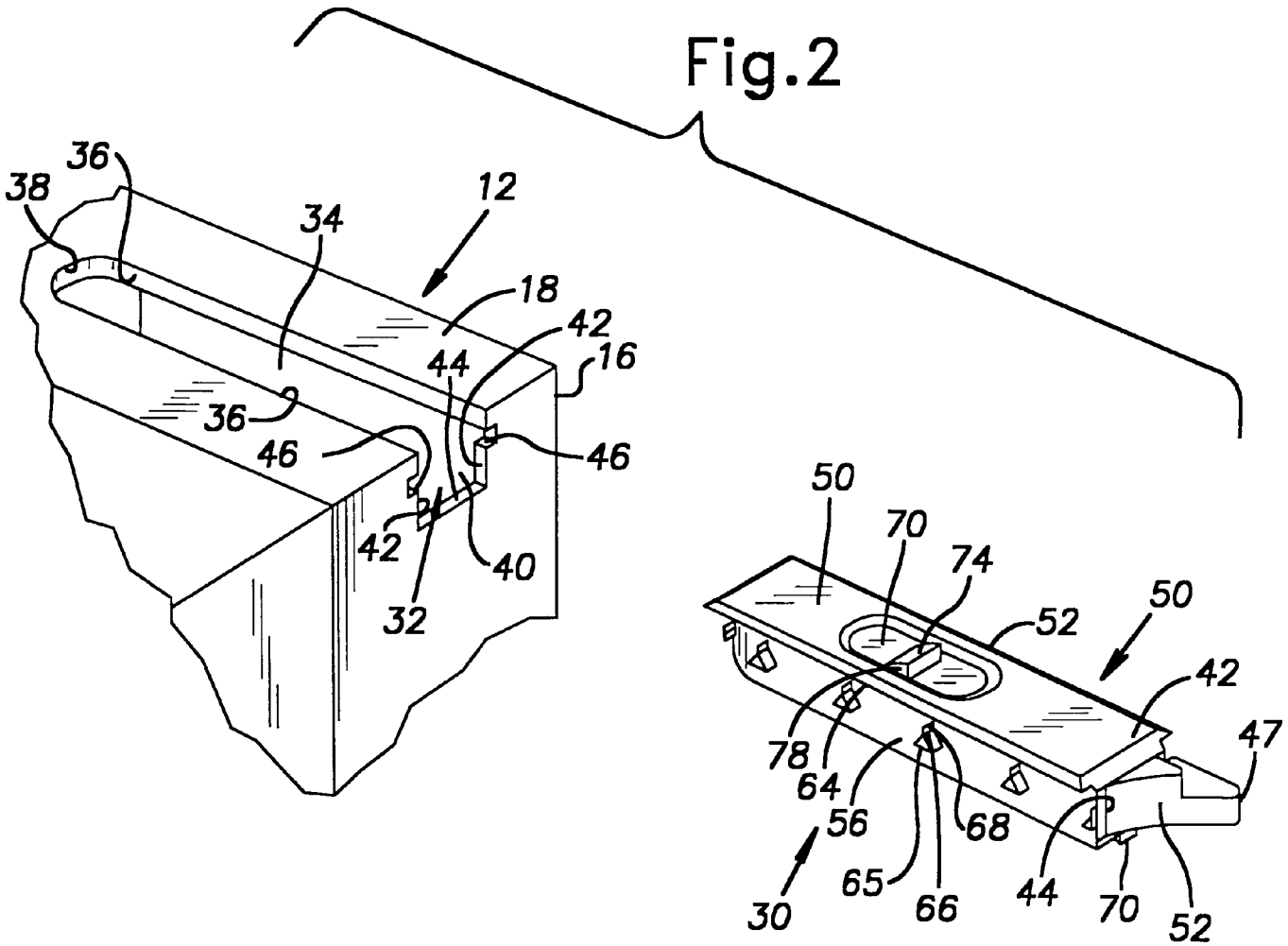
FIG. 2 shows a perspective view of a tilt latch and part of a sash of the window.

Referring to FIG. 2, an opening 32 is cut in the sash 12 for receiving the tilt latch 30 therein. The opening 32 includes a slot 34 in the header rail 18 defined by opposed edges 36 blending into a U-shaped rear edge 38. The opening also includes a slot 40 in the stile 16 defined by opposed edges 42 and a bottom edge 44. The slot 40 has notches 46 below the edges 36 of the slot 34 in the rail. The edges 36 of the header slot 34 meet the edges 42 of the stile slot 40 so that the opening 32 is continuous.

The tilt latch 30 includes a housing 50 and a movable bolt 52 projecting therefrom. The housing 50 is sized to fit in the opening 32 so that the bolt 52 extends outwardly from the stile 16.

Figure 3:
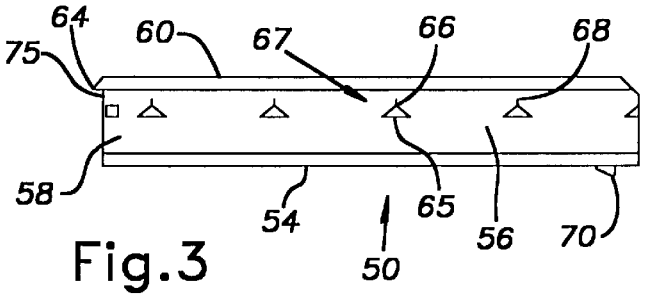
FIG. 3 shows a side elevational view of the tilt latch.
Figure 4:
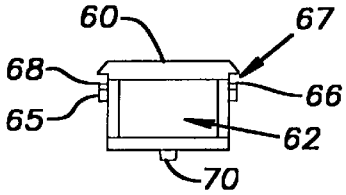
FIGS. 4 and 4A show end views of different embodiments of the latch.
Figure 4A:
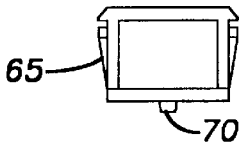

Referring to FIGS. 3 and 4, the housing 50 includes a bottom wall 54, side walls 56, a rear wall 58, and a top wall 60 defining a hollow cavity 62 opening at a front end of the housing. The top wall 60 defines a flange 64 at the top of the side and rear walls 56, 58. A plurality of retainers are provided at the side walls. The retainers are preferably protuberances 65 projecting outwardly from the side walls 56 of the housing. The protuberances are preferably triangular each having an apex 66 spaced from the flange 64 to define a gap 67. The protuberances 65 can be isosceles or right triangles or another suitable shape defining an apex. Each protuberance 65 is provided with a finger 68 extending from the apex 66 into the gap 67. The finger 68 preferably has a length of about 0.5 mm (0.020 inch), that is about 30% of the gap 67, and a thickness of about 0.5 to 0.8 mm. The finger is flexible, deformable, and shearable as discussed below. The protuberances 65 are preferably evenly space along the side walls 56. The number and spacing of the protuberances 65 depend on the dimensions of the window sash and housing. For a standard household installation, four to five protuberances are provided on each side. As shown in FIG. 4A, the protuberances 65 can be flared from the side walls 56. One or more protuberances 72 or rear flanges project from the rear wall 58 and having a lip 74 or face spaced from the flange 64 to define a gap 75.

Figure 5:
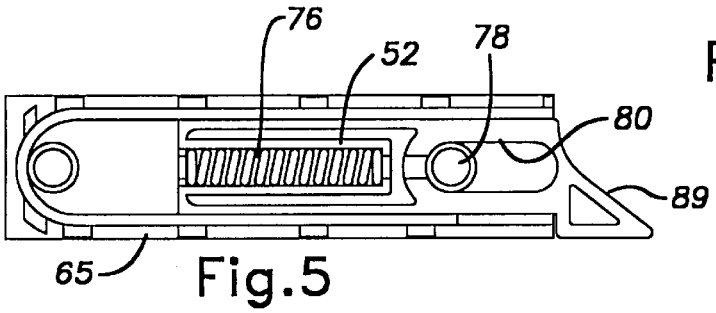
FIG. 5 shows a bottom view of the latch with the bottom cover removed.
Figure 6:
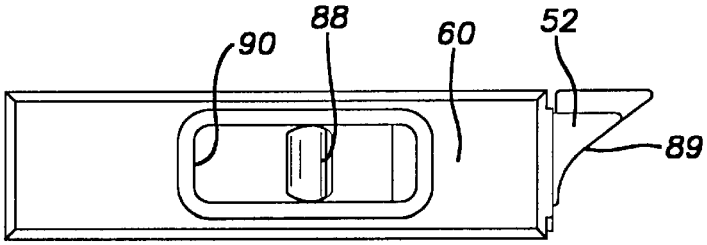
FIG. 6 shows a top view of the latch.

Referring to FIGS. 5 and 6, the bolt 52 is slidably disposed in the cavity 62 of the housing. A spring 76 biases the bolt 52 forwardly to an extended position. A post 78 extends between the top and bottom walls 60, 54 through a slot 80 of the bolt 52 and limits forward travel of the bolt. The post 78 can provide for securing upper and lower components of the housing. When the housing is a single piece, the post can be omitted. A knob 88 provided on the top surface of the bolt 52 projects through a slot 90 in the top wall 60 of the housing. A nose 89 of the bolt is adapted for engaging in the slide channel 22 (FIG. 1) for retaining the sash in the window frame. The sash is releasable by use of the knob 88 to retract the bolt 52 thereby disengaging the nose 89 from the channel 22.

Referring to FIG. 2, the tilt latch 30 is installed in the sash 12. The rear end of the housing 50 is placed adjacent the opening 32 in the stile 16. The housing 50 is moved longitudinally so that the edges 36 of the slot 36 are received the gaps 67 closest to the rear end of the housing. The edges 36 cause the respective fingers 68 to flex thereby permitting passage of the edges through the gaps 67. In some cases, all or part of the finger 68 will be sheared from the side wall 56 and/or apex 66. As the housing is moved longitudinally, the edges are sequentially received in the respective gaps until the rear wall 58 engages the rear edge 38 and the retainer 70 engages behind the wall of the stile 16 adjacent the bottom edge 44. The rear edge 38 is received in the rear gap 75. The apexes 66 and fingers 68 engage the edges 36 at discrete points along the length of the slot 34 providing a snug fit.

The tilt latch can also be installed according to an alternative installation method (not shown). The rear wall 58 of the housing 50 is placed against the rear edge 38 of the slot 34 so that the rear edge 38 is received in the rear gap 75. The front end of the housing 50 is then forced downwardly. The protuberances 65 move past the edges 36 so that the edges 36 are received in the gaps 67. As the edges 36 move into the gaps 67, the fingers 68 are flexed or sheared. The apexes 66 and fingers 68 engage the edges 36 at discrete points along the length of the slot 34 providing a snug fit. The retainer 70 engages behind the wall of the stile 16 adjacent the bottom edge 44. The housing construction shown in FIG. 4A is particularly suitable for this installation method.

Referring to FIGS. 7, 8 and 9, the pivot assembly 26 includes a housing 132 with a pivot bar 134 located therein. The housing 132 includes a body 136 having a longitudinal bore 138. The bore 138 shown is generally rectangular, but other shapes are suitable as is apparent from the following description of the pivot bar 134. The bore 138 is stepped, that is, different parts of the bore have different cross-sectional dimensions and shapes. One end of the bore defines a mouth 140 slightly wider than the pivot bar 134 to facilitate installation and allow slight flexing thereof. A main part 142 of the bore is sized to snugly retain the pivot bar 134 therein. Another end of the bore is circular in cross section and defines a stop 144 against which the pivot bar 134 abuts. Adjacent the stop, a bottom wall is recessed to define a lip 146. The pivot bar 134 has a U-shaped cross section of formed metal. One end of the pivot bar is provided with laterally extending flanges 148. A detent (not shown) projects from a bottom wall of the pivot bar near another end. The pivot bar 134 is located within the bore 138 of the housing 132 so that the pivot bar detent engages behind the lip 146 to prevent longitudinal movement of the pivot bar in one direction. An end of the pivot bar 134 engages the stop 144 to prevent longitudinal movement of the pivot bar in another direction. The pivot bar projects from the housing 132 so that the flanges are spaced from the housing.

Referring to FIG. 7, the lower end of the sash stile 16 is provided with a notch 149 or slot to allow passage of the pivot housing 132 therethrough. A second notch 150 or slot is cut in a lower wall of the lower rail 18 to define a pair of opposed edges 151. The second notch 150 is as long as the housing 132.

Referring to FIGS. 8 and 9, the housing 132 includes a top wall 154, side walls 156, a rear wall 158, and a bottom wall 160. The bottom wall 160 defines a flange 164 at the bottom of the side and rear walls 156, 158. Retainers are provided at the side walls, such as plurality of protuberances 165 project outwardly from the side walls 156 of the housing. The protuberances are preferably triangular each having an apex 166 spaced from the flange 164 to define a gap 167. The protuberances 165 can be isosceles or right triangles or another suitable shape defining an apex. Each protuberance 165 is provided with a finger 168 extending from the apex 166 into the gap 167. The finger 168 preferably has a length of about 0.5 mm (0.020 inch), that is about 30% of the gap 67, and a thickness of about 0.5 to 0.8 mm. The finger is flexible, deformable, and shearable as discussed below. The protuberances 165 are preferably evenly space along the side walls 56. The number and spacing of the protuberances 165 depend on the dimensions of the window sash and housing. For a standard household installation, five to seven protuberances are provided on each side. The protuberances can be flared from the side walls. A rear protuberance 172 or rear flange projects from the rear wall 158 and has a lip 174 or face spaced from the flange 164 to define a gap 175. A retainer 170 projects from the top of the body near one end.

Figure 10:
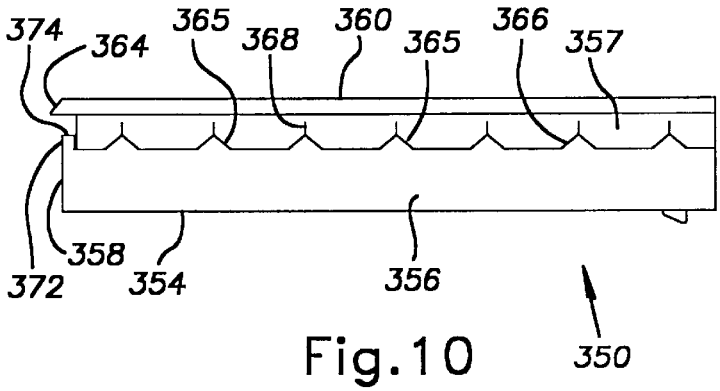
FIGS. 10 and 11 show a different embodiment of a housing.
Figure 11:
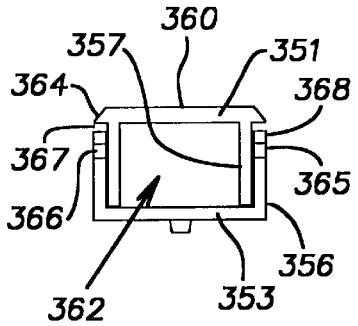

Referring to FIGS. 10 and 11, the housing 350 includes an upper part 351 and a lower part 353. The lower part 353 defines a bottom wall 354, external side walls 356, and a rear wall 358. The upper part defines internal side walls 357 and a top wall 360. The upper and lower parts 351, 353 are assembled to define a hollow cavity 362 opening at a front end of the housing. The top wall 360 defines a flange 364 at the top of the internal side walls 357 and spaced from the rear wall 358 and external side walls 356. Retainers, such as plurality of protuberances 365, project upwardly from the external side walls 356 of the housing. The protuberances are preferably triangular each having an apex 366 spaced from the flange 364 to define a gap 367. The protuberances 365 can be isosceles or right triangles or another suitable shape defining an apex. Alternatively, the protuberances can be rectangular. Each protuberance 365 is provided with a finger 368 extending from the apex 366 into the gap 367. The finger 368 preferably has a length of about 0.5 mm (0.020 inch), that is about 30% of the gap 367, and a thickness of about 0.5 to 0.8 mm. The finger is flexible, deformable, and shearable. The protuberances 365 are preferably evenly space along the external side walls 356. The number and spacing of the protuberances 365 depend on the dimensions of the window sash and housing. For a standard household installation, five to seven protuberances are provided on each side. A rear protuberance 372 projects from the rear wall 358 and has a lip 374 or face spaced from the flange 364 to define a gap.

Figure 14:
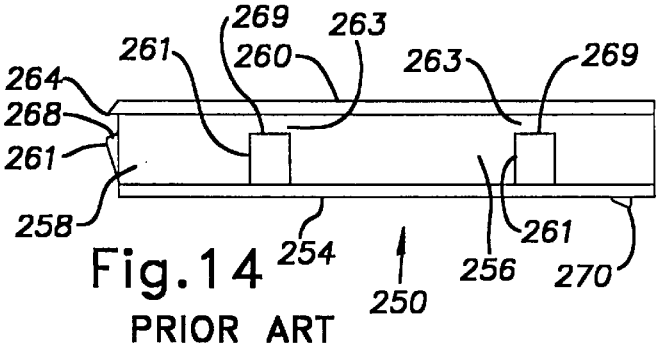
Fig.14 PRIOR ART
FIGS. 14 and 15 show a prior art tilt latch.
Figure 15:
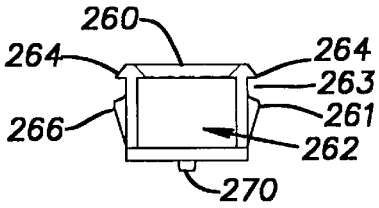
Fig.15 PRIOR ART
Figure 12:
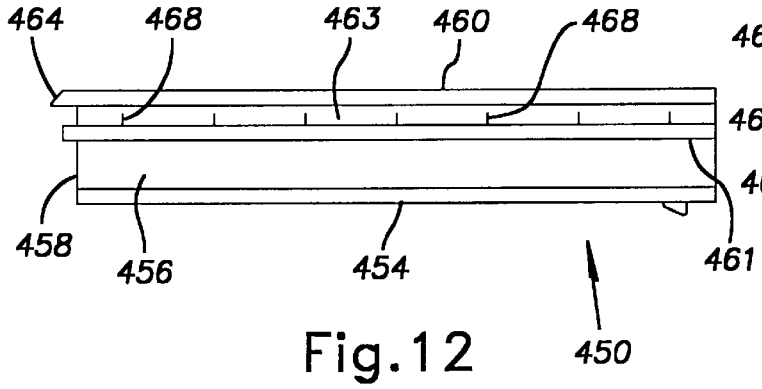
FIGS. 12 and 13 show another embodiment of a housing.
Figure 13:
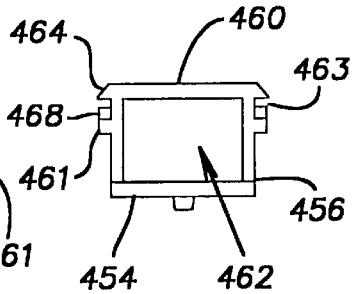
Figure 16:
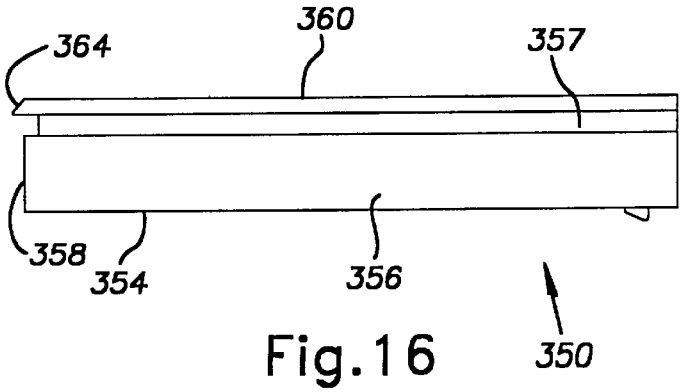
Fig.16 PRIOR ART
FIGS. 16 and 17 show another prior art tilt latch housing.
Figure 17:
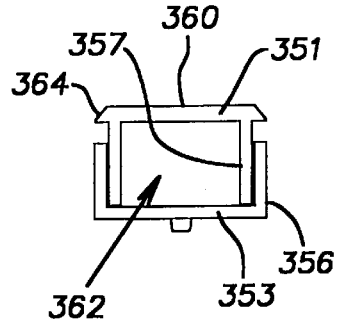
Fig.17 PRIOR ART

Referring to FIGS. 12 and 13, the housing 450 includes a bottom wall 454, side walls 456, a rear wall 458, and a top wall 460 defining a hollow cavity 462 opening at a front end of the housing. The top wall 460 defines an upper flange 464 at the top of the side and rear walls 456, 458. A retainer, such as a lower flange 461, projects outwardly from the side walls 456 and rear wall 458 of the housing. The lower flange 461 and upper flange 464 cooperate to define a longitudinal groove 463. Plural fingers 468 extend upwardly from the lower flange 461 into the groove 463. The finger 468 preferably has a length of about 0.5 mm (0.020 inch), that is about 30% of the groove 463, and a thickness of about 0.5 to 0.8 mm. The finger is flexible, deformable, and shearable. The fingers 468 are preferably evenly space along the side walls 456. The number and spacing of the fingers 468 depend on the dimensions of the window sash and housing. Similarly, fingers can be provided projecting upwardly from the lips 269 of the retainers 261 shown in FIGS. 14 and 15.

Referring to FIG. 2, the pivot assembly 26 is installed in the sash 12. The rear end of the housing 132 is placed adjacent the notch 149 in the stile 16. The housing 132 is moved longitudinally so that the edges 151 of the slot 150 are received the gaps 167 closest to the rear end of the housing. The edges 151 cause the respective fingers 168 to flex thereby permitting passage of the edges through the gaps 167. In some cases, all or part of the finger 168 will be sheared from the side wall 156 and/or apex 166. As the housing is moved longitudinally, the edges are sequentially received in the respective gaps until the rear wall 158 engages the rear edge of the slot 150 and the retainer 170 engages behind the wall of the stile 16 adjacent the top edge of the notch 149. The rear edge is received in the rear gap 175. The apexes 166 and fingers 168 engage the edges 151 at discrete points along the length of the notch 150 providing a snug fit.

The pivot assembly can also be installed according to an alternative installation method (not shown). The rear wall 158 of the housing 132 is placed against the rear edge of the notch 150 so that the rear edge is received in the rear gap 175. The front end of the housing 132 is then forced upwardly. The protuberances 165 move past the edges 151 so that the edges 151 are received in the gaps 167. As the edges 151 move into the gaps 167, the fingers 168 are flexed or sheared. The apexes 166 and fingers 168 engage the edges 151 at discrete points along the length of the notch 150 providing a snug fit. The retainer 170 engages behind the wall of the stile 16. A housing construction similar to that shown in FIG. 4A is particularly suitable for this installation method.

The present disclosure describes several embodiments of the invention, however, the invention is not limited to these embodiments. Other variations are contemplated to be within the spirit and scope of the invention and appended claims.

What is claimed is:

1. A housing for installation in a window frame having a window sash with a notch defining a pair of opposed edges, the housing comprising:

side walls;

a top wall extending beyond the side walls to define a flange;

retainers defined by triangular protuberances at the side walls, a corner of the triangle of each protuberance defining an apex, and spaced from the flange to define respective gaps for receiving the edges therein; and a plurality of fingers spaced apart along each of the side walls, the fingers projecting from the retainers toward the flange and into the respective gap.

2. A housing according to claim 1 wherein the protuberances project from the side walls.

3. A housing according to claim 1, wherein the fingers have a thickness permitting flexing thereof.

4. A housing according to claim 1, wherein the fingers have a thickness permitting shearing thereof.

5. A housing according to claim 1, wherein the fingers have a thickness of about 0.5 mm.

6. A housing according to claim 5, wherein the fingers have a length of about 0.5 mm.

7. A housing according to claim 1, wherein the fingers have a length of about 0.5 mm.

8. A housing according to claim 1, further comprising a pivot bar projecting from the housing.

9. A housing according to claim 1, further comprising a movable bolt projecting from the housing.

10. A housing for installation in a window frame having a window sash with a notch defining a pair of opposed edges, the housing comprising:

side walls;

a top wall extending beyond the side walls to define a flange; and triangular protuberances at the side walls, a corner of the triangle of each protuberance having a pointed apex facing the flange and spaced from the flange to define respective gaps for receiving the edges therein.

11. A housing according to claim 10 wherein the protuberances project from the side walls.

12. A housing according to claim 10, wherein the housing is provided with plural protuberances each defining a respective gap between the protuberance and the flange and each having a finger projecting from the protuberance into the gap.

13. A housing according to claim 12, wherein the protuberances are substantially evenly spaced along the length of each side wall.

14. A housing according to claim 10, wherein the protuberances are flared.

15. A housing according to claim 10, further comprising a rear wall of the housing and a rear protuberance projecting from the rear wall and spaced from the flange to define a gap for receiving the rear edge of the notch.

16. A housing according to claim 10, further comprising a bottom wall and a retainer projecting from the bottom wall near a front edge of the bottom wall.

17. A housing according to claim 10, further comprising a finger projecting from each protuberance into the respective gap.

18. A housing according to claim 17, wherein the fingers have a thickness permitting flexing thereof.

19. A housing according to claim 17, wherein the fingers have a thickness permitting shearing thereof.

20. A housing according to claim 17, wherein the fingers have a thickness of about 0.5 mm.

21. A housing according to claim 20, wherein the fingers have a length of about 0.5 mm.

22. A housing according to claim 17, wherein the fingers have a length of about 0.5 mm.

23. A housing according to claim 10, wherein the housing is molded as a single piece.

24. A housing according to claim 10, further comprising a pivot bar projecting from the housing.

25. A housing according to claim 10, further comprising a movable bolt projecting from the housing.

26. A housing for installation in a window frame having a window sash with a notch defining a pair of opposed edges, the housing comprising:

side walls and a rear wall;

a top wall extending beyond the side walls and the rear wall to define a flange;

plurality triangular protuberances projecting from each of the side walls, each protuberance having an apex defined by a corner of the triangle facing the flange and spaced from the flange to define respective gaps for receiving the edges therein; and a finger projecting from each protuberance into the respective gap and having a thickness permitting flexing or shearing thereof.

* * * * *